US009522418B2

(12) United States Patent
Engel et al.

(10) Patent No.: US 9,522,418 B2
(45) Date of Patent: Dec. 20, 2016

(54) METHOD AND DEVICE FOR PRODUCING METAL PROFILES HAVING A CLOSELY TOLERANCED CHAMBER DIMENSION

(75) Inventors: Peter Engel, Lohmar (DE); Alexander Becker, Bonn (DE); Thomas Voss, Troisdorf (DE)

(73) Assignee: Mannstaedt GmbH, Troisdorf (DE)

( * ) Notice: Subject to any disclaimer, the term of this patent is extended or adjusted under 35 U.S.C. 154(b) by 270 days.

(21) Appl. No.: 14/117,274

(22) PCT Filed: May 13, 2011

(86) PCT No.: PCT/EP2011/057808

§ 371 (c)(1),
(2), (4) Date: Nov. 12, 2013

(87) PCT Pub. No.: WO2012/155953

PCT Pub. Date: Nov. 22, 2012

(65) Prior Publication Data

US 2015/0132597 A1 May 14, 2015

(51) Int. Cl.
*B21D 1/02* (2006.01)
*B21B 1/088* (2006.01)
(Continued)

(52) U.S. Cl.
CPC . *B21D 1/02* (2013.01); *B21B 1/08* (2013.01); *B21B 1/088* (2013.01); *B21B 13/06* (2013.01);
(Continued)

(58) Field of Classification Search
CPC ..... B21B 1/08; B21B 1/088; B21B 1/0886; B21B 1/095; B21B 13/06; B21B 1/085; B21B 1/12; B21B 2013/106; B21D 1/02; B21D 3/02; B21D 3/05
(Continued)

(56) References Cited

U.S. PATENT DOCUMENTS 974,173 A * 11/1910 Morgan ..... B21D 39/021 72/220
3,228,220 A * 1/1966 Schneckenburger ..... B21B 1/16 72/200

(Continued)

FOREIGN PATENT DOCUMENTS

CA 2091108 A1 9/1993
CN 1076146 A 9/1993

(Continued)

OTHER PUBLICATIONS

International Search Repot issued in PCT/EP2011/057808, mailing date Aug. 2, 2012, with English Translation.

*Primary Examiner* — Edward Tolan

(74) *Attorney, Agent, or Firm* — Panitch Schwarze Belisario & Nadel LLP

(57) ABSTRACT

The invention relates to a method and device for producing metal sections having two profile flanges arranged opposite one another and having flange inner faces that are to be kept apart from each other by a closely toleranced final chamber dimension. In order to adapt the chamber dimension from a starting chamber dimension $K_0$ to a desired final chamber dimension $K_1$, the metal section is passed through the device, which forms working gaps between an inner working roll pair and outer support rolls. The working rolls that form the inner working roll pair roll over each other in order to brace the forming forces exerted on the working roll pair from the flange inner faces against each other.

10 Claims, 2 Drawing Sheets

Figure 1:
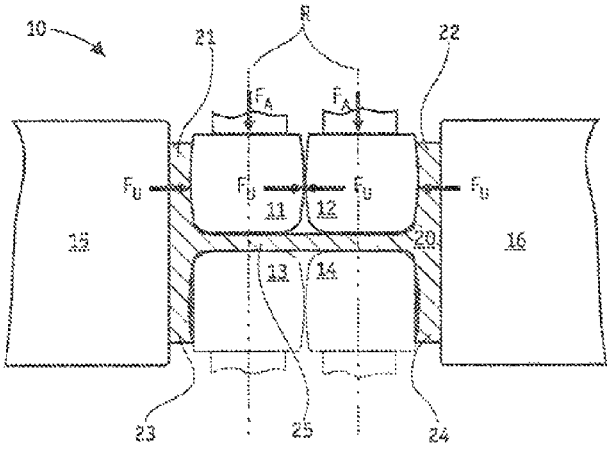

(51) Int. Cl.

| | |
|---|---|
| ***B21B 13/06*** | (2006.01) |
| ***B21B 1/08*** | (2006.01) |
| ***B21B 31/02*** | (2006.01) |
| ***B21B 35/00*** | (2006.01) |
| ***B21B 45/02*** | (2006.01) |

(52) U.S. Cl.
CPC ..... *B21B 31/02* (2013.01); *B21B 35/00* (2013.01); *B21B 45/0275* (2013.01); *B21B 1/0886* (2013.01); *B21B 2261/10* (2013.01); *B21B 2263/02* (2013.01); *Y10T 428/12375* (2015.01)

(58) Field of Classification Search
USPC ..... 72/224, 225
See application file for complete search history.

(56) References Cited

U.S. PATENT DOCUMENTS 4,942,753 A * 7/1990 Willeke ..... B21B 1/088 72/178
4,967,581 A * 11/1990 Ecrepont ..... B21D 3/05 72/187
4,982,487 A * 1/1991 Maruko ..... B21D 39/02 29/243.58
5,052,206 A * 10/1991 Reismann ..... B21B 31/16 72/13.4
5,398,372 A * 3/1995 Kush ..... B08B 5/026 15/309.1

FOREIGN PATENT DOCUMENTS

| | | | | | |
|---|---|---|---|---|---|
| JP | S56-111501 | A | | 9/1981 | |
| JP | S60-206502 | A | | 10/1985 | |
| JP | 61-262403 | A | * | 11/1986 | B21B 1/08 |
| JP | 62093008 | A | | 4/1987 | |
| JP | S63-140706 | A | | 6/1988 | |
| JP | S63-140708 | A | | 6/1988 | |
| JP | 1-293903 | A | * | 11/1989 | B21B 1/08 |
| JP | 1-293904 | A | * | 11/1989 | B21B 1/08 |
| JP | 2011201 | A | | 1/1990 | |
| JP | 2-127901 | A | * | 5/1990 | B21B 1/08 |
| JP | 5-96301 | A | * | 4/1993 | B21B 1/08 |
| JP | H05-65403 | U | | 8/1993 | |
| JP | 11244903 | A | | 9/1999 | |

* cited by examiner

METHOD AND DEVICE FOR PRODUCING METAL PROFILES HAVING A CLOSELY TOLERANCED CHAMBER DIMENSION

CROSS-REFERENCE TO RELATED APPLICATIONS

This Application is a National Stage of PCT International Application No. PCT/EP2011/057808, filed on May 13, 2011. The disclosure of the aforementioned application is incorporated herein in its entirety by reference.

The invention relates to a method and a device, particularly a roll stand, for producing or recalibrating metal sections, particularly rolled sections made from steel, with a closely toleranced chamber dimension. The invention also relates to a rolled section that is produced according to the inventive method.

For the purposes of this document, the term chamber dimension refers to the dimension between the inner face of a first flange and the inner face of a second flange opposite the first flange in the metal section. Thus, the invention relates particularly to the production and recalibrating of U or double-T sections, but the invention may also be used expediently to adjust the chamber dimension of other section geometries in which two substantially parallel flanges are located opposite one another.

Metal sections having two flanges that are positioned opposite and extend substantially parallel to one another are generally known. In certain applications, the chamber tolerances are subject to stricter requirements, particularly when the opposing inner faces of the flanges form functional surfaces that cooperate functionally with adjacent components such as rolling elements. Stricter requirements of such kind are also imposed on suspension railways.

Another specific example of such an application is that of mast uprights for mounting the mast frame on industrial transport vehicles, particularly forklift trucks. In this application, a plurality of metal sections are arranged one inside the other and are movable in the lengthwise direction of the sections telescopically with respect to each other in order to raise or lower the stacked goods. Rolls are situated between the individual metal sections as rolling elements. However, any freeplay between the metal sections and the rolls allows the metal sections to tilt toward each other transversely to the lengthwise direction of the section or the vertical lifting direction. Even a small amount of freeplay between the rolls and the area of the surface of the metal section on which the rolls roll can have a significant effect, particularly in the case of large lifting heights. If a stack of goods is located at a great height, and as often as not such stacks are very heavy, of course its freedom to rock transversely to the vertical lifting direction must be limited as far as possible, if not prevented entirely, otherwise the stability of the vehicle or the entire structure may be threatened and it may become needlessly more difficult to precisely position the goods to be moved into a high bay storage area. In some cases, manufacturers are even required to measure the sections for a mast frame individually and then assemble customized roll sets for a given vehicle. A roll set may comprise a large number of different sized rolls, each roll being individually selected for the specific section pair.

Various manufacturing methods are currently used for producing mast sections with closely toleranced chamber dimensions, particularly those made of steel.

A common feature of all these methods is that the steel is first hot rolled. However, when mast sections are hot rolled it is not possible to create parallel flanges or achieve close tolerances. Moreover, the material zones that are exposed to substantial stresses during subsequent operation are not work hardened, one of the results of which is poor run-in behaviour. Consequently, a number of different roll sizes are usually required for constructing a mast frame from sections that have only been hot rolled. Sections that have only been hot rolled also wear relatively quickly, but lend themselves well to welding and have good resistance to brittle fracture. Poor run-in behaviour can be improved by using a steel with a higher carbon content or adding alloying elements, but this in turn is associated with worsened weldability and brittle fracture resistance. However, a decisive advantage of this manufacturing process is the low cost thereof, and consequently a substantial majority of mast sections in use are produced by hot rolling only.

In order to address the drawbacks of sections that are only hot rolled as described in the preceding, the sections can be drawn afterwards. Drawing mast sections guarantees good parallelism of the flanges, close dimensional tolerances, smooth surfaces and advantageous work-hardening of the material. With drawn sections, it is therefore often possible to achieve the desired objective with just one roll size. The sections also have a low susceptibility to wear, exhibit little run-in effect and lend themselves well to welding. However, a disadvantage thereof is the significant production effort involved and associated high production costs, and for this reason drawn sections are not really competitive. In addition, the brittle fracture resistance of drawn sections is significantly inferior to that of sections produced in other ways. Drawing can also result in increased profile distortion (bending, twisting), which must then be corrected in a straightener, at significant expense.

Post-machining of the functional surfaces of previously hot rolled mast sections is also favoured at the moment. Although sections that are produced in this way lend themselves less well to welding than drawn sections, they are also cheaper to produce. Post-machining also enables good flange parallelism and close chamber tolerances to be achieved. As for drawn sections, with this process it is generally also possible to use only one roll size. Furthermore, the sections do not show any signs of surface decarburization due to the post-machining, which are possible in sections that have only been rolled. Nevertheless, this method has drawbacks, in view of the post-machining required and the associated material and tooling labour. It is also significantly more expensive than the process in which mast sections are only hot rolled.

At the same time, drawbacks are associated with all of the aforementioned methods. The object of the invention is therefore to provide a process for producing or recalibrating metal sections, and a device for carrying out such a method which as far as possible combines the advantages of the known processes described above. A method and an apparatus are suggested with which it is possible to produce in particular mast uprights having parallel flanges, close tolerances and high material strength with regard to wear. The objective is a mast section that dispenses with the need for multiple roll sizes when constructing a mast frame, features good wear characteristics, weldability and resistance to brittle fracture, exhibits good run-in behaviour, and which can still be produced at lower cost than machined mast sections.

This object may be achieved according to the invention with a rolling stand and a method as may be described in one or more of the accompanying claims.

Unlike the previously described methods of recalibrating sections that that have only been hot rolled by drawing or post-machining, the apparatus and method according to the invention enables previously rolled section blanks in particular to be recalibrated by rolling in the temperature range associated with cold forming. With this recalibration step, it is possible to achieve a high level of flange parallelism, close chamber tolerances and to implement controlled work hardening of the material with definable parameters in the area of the flange inner faces close to the surface, which are subjected to particularly high stresses in mast sections. When sections manufactured in this way are used to construct mast frames, the desired result can be achieved with a single roll size. The material lends itself well to welding, the work-hardened flange inner faces exhibit good wear properties and low run-in freeplay. Brittle fracture resistance is good. The surface quality of the flange inner faces is also good, since any unevennesses or striations from the hot rolling process are compensated or smoothed by the rolling operation that is performed on the flange inner face. Manufacturing costs are significantly lower than the manufacturing costs entailed with post-machined sections. Accordingly, the inventive device and method can be used to create special profiles with particularly strict chamber dimension tolerances at a favourable cost, without the need for cold drawing or post-machining steps.

The arrangement of the two inner working rolls such that they roll over the inner face of the flanges and at the same time touch one another in the middle between the two flanges ensures that the high surface pressures on the flange inner faces that are essential for cold forming are applied consistently and can be braced simply and efficiently. Of course, the inner working rolls are made from an extremely high-strength material for this purpose, particularly a highly hardened and tempered steel (for example 100Cr6) or a resilient ceramic material, each with very good surface quality.

Typically, a support body is assigned to each inner working roll. This body braces the corresponding flange outer face against the forming forces exerted on the inner face of the section flange by the respective inner working roll. The support bodies preferably consist of a first support roll and a second support roll, which are supported rotatably in the roll stand in the same way as the inner working rolls.

Besides the use of support rolls, other types of support bodies may also be employed. The choice of support bodies depends on the way in which the metal section and the roll stand are moved relative to each other, among other factors. As an alternative to support rolls, which are preferably used when the metal section is moved relative to a stationary roll stand or when the inner working rolls are moved together with the support rolls relative to a fixedly clamped metal section, it may also be provided to use plate-like support bodies that rest on the outside of the flanges and brace against the forming forces exerted by the working rolls on the inner faces of the flanges. The metal section may then be clamped fixedly and held in place between the support bodies bearing on the outside thereof. For this purpose, the support bodies are preferably formed by elongated, plate-like bodies or support rails that are aligned with one flat bearing surface against the outer faces of the flanges and provide bracing against the forming forces. In this case, the support bodies or support rails may extend for the entire length of the metal section that is to be machined.

Another alternative possibility is to use a support body consisting of individual plates connected to each other in articulated manner like chain armour. These single plates that are connected in this way can also exert the necessary thrust forces on the metal section to be moved in order to displace it relative to a stationary pair of working rolls, or they can be moved together with and as part of the roll stand, and preferably used to transmit the required thrust forces to pair of working rolls that is moving relative to the stationary metal section.

At all events, with due consideration for the circumstances of the application concerned, a person skilled in the art will decide in each case the most suitable method by which the roll stand comprising the working roll pair and the metal section are to be moved relative to each other, and in particular the question of whether the metal section is clamped fixedly and the working roll pair is pushed or pulled between the flanges or whether the metal section is displaced relative to a stationary pair of working rolls. The same applies for the question of how the feed forces necessary for this are transferred to the metal section or to the roll stand.

When the metal section is loaded correctly in the roll stand and when the roll stand and the metal section are moved relative to each other, the first flange is between the first inner working roll and the first outer support body, that is to say in the first working gap, and the second flange is rolled between the second inner working roll and the second outer support body, that is to say in the second working gap.

The term "working gap" is intended to imply that the forming work is performed primarily by the forces exerted on the inner faces of the flanges by the inner working rolls, and the support bodies only provide bracing outwardly against the forces exerted by the inner work rolls on the flange inner faces, to prevent lateral deformation or deflection of the flanges and/or to prevent stretching of the profile web located between the flanges, in other words to prevent the web height from being altered. In this context, the distance between the support bodies is adjusted according to the distance between the flange outer faces. The deformation and consequent creation of the intended chamber dimension can be achieved by these measures as a consequence of actual, localized reduction in the flange material thickness through plastic deformation of the flange material located near the surface on the flange inner face.

Since it is not an object of the invention to recalibrate the web height of the section or to change the flange outer face by cold forming, but rather to be able to produce the distance between the flange inner faces and to create the surface contour thereof transversely to the lengthwise direction of the section within close tolerances, in a preferred embodiment it is provided that the support bodies are dimensioned such that when the device is used in the intended manner the surface pressure between the flange outer face and the support body is so low that no significant plastic deformation of the flange material located near the surface of the flange outer face takes place.

The various manufacturers of industrial transport vehicles typically use proprietary rolling element and roll shape geometries for their mast sections. The invention makes it possible to adapt the surface of the flange inner face to the manufacturer-specific rolling element and roll shape geometry even while the mast sections are being manufactured through the use of manufacturer-specific working roll shapes. For this, the inner working rolls have a non-cylindrical outer contour in the region of the contact surface that is created between the inner working roll and the flange inner face when the device is used as intended. The outer contour of this contact surface may be reproduced on the flange inner face during the cold forming process.

Deformation of metal sections to obtain the desired chamber dimension can be performed either before the metal section is introduced into a roll straightening device or also between individual roll straightening operations.

Deformation of the metal section to obtain the desired chamber dimension before a final pass through a roll straightening machine and/or final post-machining in a straightening press is particularly advisable because it cannot always be guaranteed that uneven degrees of deformation will not occur, and which might result in twisting or bending of the metal section, for example, and which would have to be corrected again with a roll straightening machine and/or a straightening press. The roll stand may also be integrated in a roll straightening machine. In this case the roll stand should be movable within the roll straightening machine so that it is possible to compensate for any movements of the metal section transversely to the lengthwise direction of the section.

During the rolling process, the inner working rolls, which rotate about an axis of rotation, are preferably acted upon by a contact pressing force acting in the direction of the axis of rotation and pressing the inner working rolls toward the profile web, which ensures that the inner working rolls always lie fully flat in the transition from the flange to the web of the metal section or at least are kept at a defined distance from the web. The optionally manufacturer-specific deformation created on the flange inner face by the inner working rolls remains constant for the entire lengthwise direction of the section. In this way, the working rolls can be effectively prevented from drifting away from the plane defined by the profile web surface toward the outside of the section. Of course, this pressing force may be provided instead or in addition by a pressure roll which is arranged on the side of the metal section farthest from the working roll pair and aligns the metal section against the working roll pair to prevent the metal section from drifting with regard to the working roll pair while it is moving.

In order to prevent the frontal faces of the inner working rolls opposite the web from leaving tracks on the web, a spacer may also be provided to retain the inner working rolls at a defined distance from the web surface despite the pressing force that biases the rolls toward the profile web. Such a spacer may be a spacer roll or some other rolling element, which rolls or slides gently on the web surface as the section moves relative to the roll stand.

Also advantageously, the device comprises a first cleaning apparatus, which cleans impurities from areas of the metal section before they enter the roll stand. Such impurities can be caused by scale, which flakes off of the section surface during upstream process steps. The cleaning apparatus can blow the impurities off particularly with compressed air, wash them off with water or remove them with brushes or a combination of these processes. The cleaning process preferably takes place continuously during while the metal section is moving relative to the roll stand. The support body and/or the inner working rolls may also be cleaned in the same way with the first cleaning apparatus or also with an additional, second cleaning apparatus.

The rolling process may be carried out in multiple stages, particularly if the degree of deformation necessary to achieve the desired chamber dimension is so great that it is difficult to carry out in a single pass. Accordingly, the metal section may either be passed through the same roll stand multiple times, or it may be passed through multiple roll stands arranged one after the other, wherein the pressure applied to the metal section or geometry of the inner working rolls and/or of the working gap may be adapted in steps.

In order to remove beads that may occur in a single step with the rolling process, a device for removing beads, particularly a plane, may be arranged on the roll stand or on the apparatus in which the roll stand is embedded.

It may be provided to drive the inner working rolls with a motor in order to ensure the movement of the roll stand and the metal section relative to each other. Alternatively or in addition thereto, it may be provided that the outer support bodies are formed by motor-driven support rolls. The pressure roll described previously may also be motorized instead of or as well as the working and/or support rolls.

Additional features and advantages of the invention will become apparent from the subordinate claims and from the following description of preferred embodiments with reference to the drawing.

Figure 2:
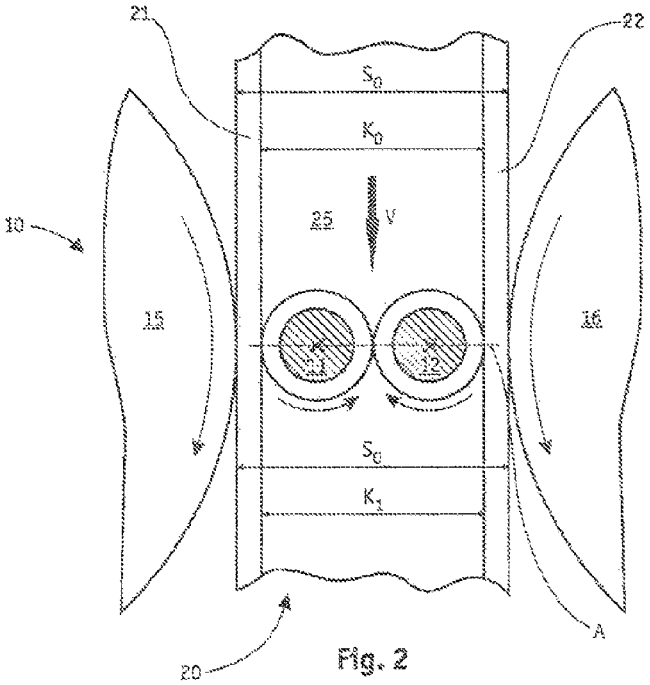
Figures 3A, 3B, 3C:
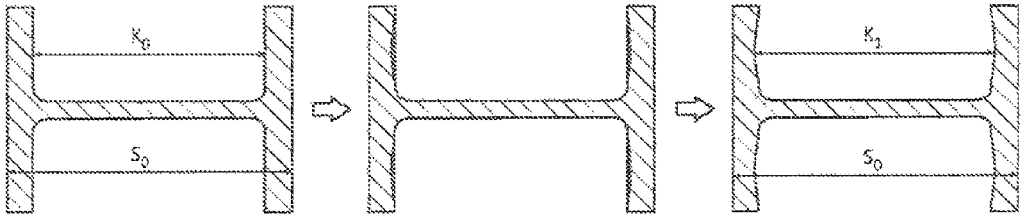
Figure 4:
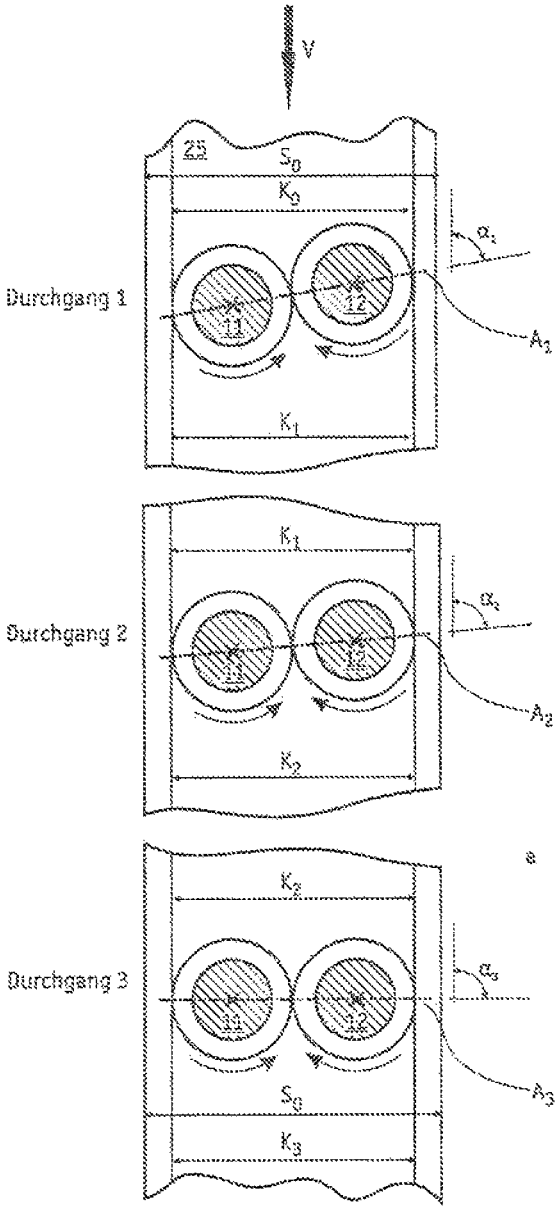

In the drawing:

FIG. 1 shows a front view of a roll stand, in which flanges of a metal section are transported between inner working rolls and outer support rolls, and FIG. 2 shows a plan view of the arrangement of FIG. 1, FIGS. 3*a* to 3*c* show the change in the metal section in stages, starting from a rolled section blank (FIG. 3*a*) until the recalibrated metal section (FIG. 3*c*), and FIG. 4 shows the expansion of a chamber dimension of a metal section in steps through stepped adjustment of the inner working rolls relative to direction of advance V.

FIG. 1 shows a front view of a roll stand 10 that constitutes the apparatus of the invention, in which flanges 21, 22, 23, 24 of a metal double-T section 20 chosen here for exemplary purposes are advanced between inner working rolls 11, 12, 13, 14 and outer support rolls 15, 16. Flanges 21 and 23 are each a first flange within the terms of the invention, and flanges 22 and 24 are each a second flange within the terms of the invention.

Inner working roll 11 is a first inner working roll, and inner work roll 12 is a second inner working roll within the terms of the invention. Together they form an inner working roll pair, which is arranged between flanges 21 and 22. Similarly, inner working roll 13 is a first inner working roll and inner working roll 14 is a second inner working roll within the terms of the invention, and together they form a further inner working roll pair which is arranged between flanges 23 and 24. A first support roll 15 acts on flanges 21 and 23 from the outside, and a second support roll 16 acts on flanges 22 and 24 from the outside. Thus, the configuration shown in FIG. 1 shows two first inner working rolls 11, 13 as defined according to the invention, and two second inner working rolls 12, 14 as defined according to the invention.

A first working gap is formed between first inner working roll 11 and first outer support roll 15, a second working gap is formed between second inner working roll 12 and second outer support roll 16. In the same way, a first working gap as defined according to the invention is formed between first inner working roll 13 and first outer support roll 15; and a second working gap as defined according to the invention is formed between second inner working roll and second outer support roll 16. Thus, in the configuration shown in FIG. 1 a total of four working gaps are shown, that is to say two first working gaps as defined according to the invention and two second working gaps as defined according to the invention.

The double arrangement of a total of two inner working roll pairs, two first flanges, two second flanges, two first working gaps and two second working gaps described in the preceding is then of course dispensed with in favour of a simple arrangement if a single chamber (for example a U-section), not a double-chamber section (for example a double T-section) is to be produced or recalibrated.

FIG. 2 shows a plan view of the configuration of FIG. 1. Outer support rolls 15 and 16 and inner working rolls 11 and 12 rotate in the direction indicated in FIG. 2 by the rotation direction arrows. The metal section is moved in a feed direction V relative to the roll stand. Alternatively, the roll stand may also be moved relative to the metal section, which is clamped in fixed position. Before flanges 21 and 22 enter the first and second gaps between first inner working roll 11 and first outer support roll 15, and between second inner working roll 12 and second outer support roll 16 respectively, the flange inner faces are separated from one another by a chamber dimension $K_0$ in the area that will come into contact with the inner working rolls and on which rolling elements will roll during subsequent use as mast sections. Metal section 20 also has a web height $S_0$.

As the respective flange passes through the respective working gap, the inner working rolls exert deformation forces on the flange inner faces, resulting in cold forming of the flange inner faces and thus also to work hardening and surface smoothing near the surface thereof. This process is illustrated in greater detail in FIG. 1. In FIG. 1, force arrows $F_U$ are shown in the upper chamber of double T-section 20 to indicate how the deformation forces acting transversely to the lengthwise direction of the section between flanges 21 and 22 cancel each other out. Only the forces from support rolls 15 and 16 that act on the flange outer faces must be absorbed by the bearing of the outer support rolls (not shown). This is achieved in that inner working rolls 11 and 12 roll over each other, and the forces arising thus counteract each other directly. This enables a bearing arrangement for the shafts adjoining the inner working rolls that only has to be capable of absorbing extremely small forces acting transversely to the lengthwise direction of the section, if any at all. In the lower chamber of the double T-section 20 shown in FIG. 1, inner working rolls 13, 14 are only indicated schematically so that the material area on which the working rolls have a deforming and work hardening effect (highlighted in black) can be shown more clearly.

Force arrows $F_A$, which are also shown in FIG. 1 indicate a pressing force acting on the working roll pair in the rotating direction of axis of rotation R, which guarantees that the working roll pair cannot drift upward in a movement away from section web 25.

Regarding the inner working rolls, for a desired final chamber dimension $K_1$ each inner working roll will have a nominal diameter of ½ $K_1$, that is to say half of desired final chamber dimension $K_1$. For typically used chamber dimensions between 60 mm and 200 mm, therefore, inner working rolls with nominal diameters between 30 mm and 100 mm would be used. The nominal diameter may optionally be increased by an additional amount to take into account the fact that the flange material and the material of the inner working rolls themselves have a certain material elasticity, and when subjected to the deforming forces they too yield elastically, that is to say without lasting plastic deformation, albeit only slightly, and then spring back. The actual diameter may thus be slightly larger than the nominal diameter ½ $K_1$.

Another special feature of the method and roll stand is that the inner working rolls may have a non-cylindrical outer contour at least in the area where they are in contact with the flange inner faces during the forming process. In the Figures, the inner working rolls are shown bulging outward for illustrative purposes. Consequently, they have a cross-section like a convex, outwardly positively curved convergent lens. However, other cross-sectional shapes are conceivable in principle, particularly a cross-section like a concave, outwardly negatively curved divergent lens, or variable outer contour progressions. This makes it possible to take into account defined, possibly manufacturer-specific roll shapes and replicate the outer contours thereof even in the flange inner faces even in the manufacturing process. This reduces the run-in freeplay, which becomes larger over the operating life of a mast frame and approaches a limit value since the rolls roll over a surface that is matched with the outer contour thereof from the very beginning, and consequently score said surface to a much lesser degree during the operating life. Ideally, this scoring is prevented completely.

It is also possible to produce non-parallel flange inner faces with the method, by corresponding design of the outer contour of the inner working rolls. In this context, the non-parallelism may be of such nature that a closing chamber dimension is created starting from the web (the effective outer diameter of the inner working rolls becomes smaller in a direction away from the web surface), and may also be of such a nature that an opening chamber dimension is created starting from the web (the effective outer diameter of the inner working rolls becomes larger in a direction away from the web surface). Moreover, with hot rolled steel sections the method and roll stand enable the flange inner faces that typically originate from the web and are not parallel but opening to be formed in such manner that they subsequently extend parallel.

FIGS. 3*a*, 3*b* and 3*c* illustrate the forming process again. FIG. 3*a* shows the cross-section of the metal section before the flanges are introduced into the working gaps. The material areas close to the surface on the flange inner faces that are machined during the process and in the roll stand are indicated by the areas highlighted in black in FIG. 3*b*. Finally, FIG. 3*c* shows the cross section of the mast section with the chamber dimension that has been changed from the initial chamber dimension $K_0$ to the desired final chamber dimension $K_1$.

As may be seen in FIG. 1 and FIG. 2, the diameter of the outer support rolls is considerably greater than the diameter of the inner working rolls, so that the surface pressure on the outer face of the flange is kept low. This is necessary particularly if it is important for the forming process not to affect web height $S_0$ or the flange outer faces. This is represented in FIG. 2 by the fact that web height $S_0$ is the same before and after passing through the roll stand, whereas the initial chamber dimension $K_0$ has been changed to the desired initial chamber dimension $K_1$. On the other hand, minor changes in web height $S_0$ and the distance between the flange outer faces are acceptable however, provided such changes do not have an adverse effect when the section is used subsequently.

Regarding the support body, it has been found that the contact area with the outer surface of the section flanges ensures a surface pressure that is then low enough to avoid plastic deformation on the flange outer face if the effective diameter of the support body is about 700 mm to 750 mm or more at this point. However, this is not to be understood as a fixed value. Practical results can also be obtained with values other than these depending on the material of the metal section.

However, it should be noted that the support bodies do not necessarily have to be formed by a support roll. For example, they may also be formed by a plate or rail with side lay or by a plurality of individual plates connected to one another in articulated manner like chain armour, generally forming a flat, even support surface. The choice of support body shape will depend among other factors on whether the roll stand is displaced relative to a fixedly clamped metal section, or whether the roll stand is installed immovably and the metal section is moved with respect to the roll stand. Particularly in the latter case, it is reasonable to use a motor to drive the inner working rolls and/or the support bodies if they are in the form of support rolls. If both the support rolls and the inner working rolls are motorized, of course care should be taken to ensure that the surface velocities of the motors are synchronised.

Since a support roll does not have to carry out any forming tasks, it may be enclosed or coated in a slightly yielding and/or high-friction drive coating, for example hard rubber, and dimensioned appropriately to bridge or make allowance for unevennesses in the flange outer face and/or to ensure slip-proof transport of the material for rolling. Such a coating also contributes to the certain application of the desired, low surface pressure on the flange outer face.

Of course, the first and second support bodies may also be formed by a single component, which provides bracing against the forming forces on both sides, that is to say on both the first and second flanges.

FIG. 4 illustrates a special variant of the roll stand and the method according to the invention, in which angle $\alpha$ that is described by notional connecting axis A that notionally connects the centre points of the two inner working rolls to the longitudinal side of the section, or feed direction V, is increased. In particular, the angle is changed from an angle of less than 90° to an angle of essentially 90°. This increases the effective outer working dimension of the inner working rolls that acts on the flange inner sides and the working gap is narrowed progressively while the outer support rolls are kept at a constant distance from each other. The outer support rolls, which of course must be provided in order to form the working gap together with inner working rolls 11, 12, are not illustrated in FIG. 4 purely for the sake of clarity.

In particular, such a configuration provides the capability of changing the chamber dimension in steps starting from original chamber dimension $K_0$ (metal section has not yet undergone any processing) to final chamber dimension $K_3$. In a first pass, axis $A_1$ with the longitudinal side of the section or feed direction V encompasses an angle $\alpha_1$ in order to enlarge chamber dimension $K_0$ to $K_1$. In a second pass, angle $\alpha_1$ is increased to $\alpha_2$ to narrow working gap slightly and thereby enlarge chamber dimension $K_1$ to $K_2$. In a third pass, angle $\alpha_2$ is increased to angle $\alpha_3$ to narrow the working gap again and thus also to enlarge chamber dimension $K_2$ to chamber dimension $K_3$, which then represents the final chamber dimension as illustrated in FIG. 4. Of course, the necessary or reasonable number of passes and therewith the number of alignment changes of the inner working roll pair and the number of times the working gap is narrowed can be determined for the respective application case.

In the multi-step method described above, angle $\alpha$ is increased incrementally in order to incrementally narrow the working gap, which however is otherwise kept constant for each passage. However, the inclined position of the rolls relative to the feed direction shown in FIG. 4, that is to say the offset between notional connecting axis A and the associated narrowing of the working gap, can also be used to compensate any variations in the chamber dimension that may exist over the length of the metal section. Slight deviations with regard to the chamber dimension that are detectable in the middle portion of the metal section and are caused by the run-in and run-out of the metal section from the working gap particularly at the beginning and end of the metal section, can be adjusted within a limited range. The inclined position of the inner working rolls relative to the feed direction shown in FIG. 4 may thus be carried out not only incrementally for a series of passes, wherein the inclined orientation may be kept constant for each pass, but it can also be altered in controlled manner during a pass, in order to selectively equalize any deviations in a measured actual chamber dimension along the length of the metal section.

For this purpose, it is recommended to allocate a measuring device to the inner working roll pair and to a displacement and control device with which angle $\alpha$ is set, which measuring device detects the actual chamber dimension during a pass. The measuring point or measured value preferably precedes the working gap, so that when a deviation is detected angle $\alpha$ can be adjusted immediately in response. However, it is also conceivable that the measuring point or measured value trails the working gap, or that a both a preceding and a trailing measurement value are captured. This last option in particular offers the advantage that the system can immediately detect the change in the chamber dimension effected by this adjustment, and can carry out a computer-assisted readjustment or correction by altering angle $\alpha$. Moreover, a kind of self-teaching system could be developed in this way, which system calibrates itself and is able to determine automatically the dependency of the degree of work hardening from the angle setting or variables subordinate thereto.

The maximum value by which angle $\alpha$ may differ from 90°, that is to say the degree by which axis A is offset from feed direction V, will vary according to the material of the metal section and according to the set pass reduction, and must be selected such that sufficient bracing of the inner working rolls against each other is guaranteed, and that the resulting torque with which the forces acting on the internal work rolls force them into an even more inclined position, remains controllable.

Although the description and representation only explicitly mentions a double T-section in the figures, it should again be noted that the invention is not limited to the production or re-calibration of only such a metal profile type, but may also be applied to all other profile shapes that comprise two opposing flanges between which at least one pair of inner working rolls may be practically put to use.

LIST OF REFERENCE SIGNS

10 Device/roll stand
11, 13 First inner working rolls
12, 14 Second inner working rolls
15 First support body
16 Second support body
20 Metal section
21, 23 First flanges
22, 24 Second flanges
25 Profile web

What is claimed is:

1. A method for producing a metal section having a first flange and a second flange opposite the first flange, which are to be spaced apart from another by a closely toleranced final chamber dimension, the method comprising:

positioning the first flange in a first working gap that is formed between a first outer support body and a first inner working roll of a working roll pair of a device;

positioning the second flange in a second working gap that is formed between a second outer support body and a second inner working roll of the working roll pair; and displacing the metal section and the device relative to one another in a lengthwise direction of the section, wherein the inner working rolls roll on the flange inner faces and reshape the flange material in a cold forming process and the material of the inner faces of the first and second flanges is work-hardened, wherein the first inner working roll and the second inner working roll roll over each other and the forming forces acting on the working roll pair transversely to the lengthwise direction of the section from the flange inner faces are braced against each other, and wherein a web height of a profile of the metal section is maintained substantially unchanged.

2. The method according to claim 1, further comprising readjusting the metal section in a roll straightening machine and/or in a straightening press.

3. The method according to claim 1, wherein the inner working rolls rotate about an axis of rotation and are loaded with a pressing force acting in a direction of the axis of rotation and forcing the inner working rolls toward a profile web.

4. The method according to claim 1, wherein the inner working rolls have a non-cylindrical outer contour in a region of a contact area that is formed between the inner working roll and flange inner face when the device is used as intended, and wherein an outer contour is transferred to the flange inner face during a forming operation that takes place on the flange inner face.

5. The method according to claim 1, further comprising removing a rolling bead that is formed during a reshaping operation immediately after the reshaping operation by an apparatus integrated in the device.

6. The method according to claim 1, wherein the method is carried out in multiple stages, either by passing the material to be formed through one device multiple times and adjusting a working gap geometry and/or forces acting on the flange inner faces in the working gap, or by passing the material to be formed consecutively through multiple devices, each having different working gap dimensions.

7. The method according to claim 1, further comprising moving the metal section relative to the stationary device in the lengthwise direction of the section.

8. The method according to claim 1, further comprising moving the device relative to a metal section that is immobilized by clamping.

9. The method according to claim 1, wherein the metal section is immobilized by clamping between the first outer support body and the second outer support body, and wherein the working roll pair moves between the first flange and the second flange in the lengthwise direction of the metal section and the first and second outer supporting bodies, reshaping the flange inner faces.

10. A rolled section, produced by the method according to claim 1.

* * * * *